US009446415B1

(12) United States Patent
Renzoni et al.

(10) Patent No.: US 9,446,415 B1
(45) Date of Patent: Sep. 20, 2016

(54) PORTABLE FLEXIBLE SLUICE BOX WITH AIRFOIL-SHAPED FLARE

(71) Applicants: Douglas R. Renzoni, Georgetown, CA (US); Valerie J. Anastasi-Renzoni, Georgetown, CA (US)

(72) Inventors: Douglas R. Renzoni, Georgetown, CA (US); Valerie J. Anastasi-Renzoni, Georgetown, CA (US)

( * ) Notice: Subject to any disclaimer, the term of this patent is extended or adjusted under 35 U.S.C. 154(b) by 18 days.

(21) Appl. No.: 14/706,261

(22) Filed: May 7, 2015

(51) Int. Cl.
*B07B 1/49* (2006.01)
*B03B 5/06* (2006.01)

(52) U.S. Cl.
CPC ..... *B03B 5/06* (2013.01)

(58) Field of Classification Search
CPC ..... B03B 5/06
USPC ..... 209/420, 506; 428/167, 182, 191
See application file for complete search history.

(56) References Cited

U.S. PATENT DOCUMENTS 2,926,786 A * 3/1960 Craft ..... B03B 5/26 209/458
3,941,690 A * 3/1976 Powers ..... B03B 5/26 209/44
4,375,491 A * 3/1983 Honig ..... B03B 5/26 209/485
5,785,182 A * 7/1998 Ashcraft ..... B03B 5/26 209/44
8,322,536 B2 * 12/2012 Rieck ..... B03B 5/26 209/3

* cited by examiner

*Primary Examiner* — Terrell Matthews
(74) *Attorney, Agent, or Firm* — Craig A. Simmermon

(57) ABSTRACT

Portable flexible sluice box with airfoil-shaped flare is a flexible sluice box. The entire portable flexible sluice box with airfoil-shaped flare can be rolled up into a compact cylindrical roll. Portable flexible sluice box with airfoil-shaped flare comprises a flexible airfoil-shaped flare attached to a flexible riffle sheet. Flexible airfoil-shaped flare is a tube of flexible material partially filled with particulate matter to yield a flexible tube member with an airfoil-shaped cross section when laid out laid out flat on a horizontal surface. Flexible riffle sheet is a rectangular-shaped flexible sheet of material with a plurality of parallel ridges protruding from its upper surface. Portable flexible sluice box with airfoil-shaped flare may further comprise a set of two wall insert pockets and a set of two rigid inserts. This optional structure essentially adds a wall to the left and right edges of flexible riffle sheet.

6 Claims, 6 Drawing Sheets

PORTABLE FLEXIBLE SLUICE BOX WITH AIRFOIL-SHAPED FLARE

BACKGROUND OF THE INVENTION

1. Field of the Invention

This invention relates to a placer mining device and specifically to a sluice box device that is used to separate precious metals and minerals from other materials found in a placer mineral deposit, which may be found on or below the earth's surface.

2. Description of Related Art

A placer deposit is a natural concentration of heavy metals and/or minerals caused by weathering processes and gravity. Precious metals and minerals were deposited or were formed deep in the earth's crust. Seismic or volcanic movement of the crust can bring some of these deposits closer to the surface where weathering make act upon them. Weathering is the flow of wind, water, ice, and/or soil across the earth's surface, which can free these deposits for distribution by the flow of wind, water, ice, and/or soil. Gravity causes a downhill direction of this flow and also causes the heavier minerals in the flow to collect in the certain low areas along the flow path. These collection areas are called placer deposits or placer mineral deposits. There are about a dozen specific types of placer deposits such as: residual, alluvial, eluvial, stream, bench, flood placers, and others. Many sizable placer deposits formed on the earth's surface millions of years ago and are now located below the current surface, under layers of natural sediments and deposits. The heavy minerals or metals deposited in a placer deposit can be very valuable. Examples of such valuable minerals include: diamonds, rubies, sapphires, emeralds, and many others. Examples of such valuable metals include: gold, silver, platinum, palladium, mercury, titanium, uranium, zirconium, and many others.

Placer mining devices use the same principles that created the placer deposits in the first place to help separate the valuable minerals from all other materials in the placer deposit. Placer mining devices introduce all material from the placer deposit into a specially engineered flow of liquid or gas that is essentially a carrier flow used to separate heavier material from lighter material. The specially engineered flow of liquid or gas is typically circulative in a closed loop. The specially engineered flow of liquid or gas causes the lighter materials to rise to the top of the flow and the heavier materials to fall to the bottom of the flow. Placer mining devices have an unobstructed top portion of the flow path and an obstructed or semi-obstructed bottom portion of the flow path. Obstructions act as collection compartments where heavier materials tend to fall into and accumulate therein while lighter material flows through the unobstructed top portion, thereby separating the light and heavy materials. One type of placer mining device is a sluice box. A sluice box utilizes the flow of liquid, usually water, through a box with obstruction ridges on the bottom.

This invention is a special type of sluice box that is portable, flexible, and capable of being rolled up into a compact cylinder of a relatively small size that can be easily carried and transported by one person. The portable sluice box of this invention can be relatively easily transported across mountainous terrain by one person, and without machinery, trucks, tractors, wheelers, or other vehicle, and without roads or trails. There are other portable sluice boxes in the prior art; however, none have the aspects disclosed in this application.

BRIEF SUMMARY OF THE INVENTION

Portable flexible sluice box with airfoil-shaped flare is a sluice box device with a flexible flare and flexible riffles.

It is an aspect of portable flexible sluice box with airfoil-shaped flare to be flexible and capable of being rolled up into a compact cylindrical roll for easier transport.

It is an aspect of portable flexible sluice box with airfoil-shaped flare to have an airfoil-shaped flare member that is flexible.

It is an aspect of portable flexible sluice box with airfoil-shaped flare to have a sluice box sheet member that is flexible.

It is an aspect of a mode of portable flexible sluice box with airfoil-shaped flare to be portable and capable of being carried by one person.

DEFINITION LIST

| Term | Definition |
|---|---|
| 5 | Portable Flexible Sluice Box with Airfoil-Shaped Flare |
| 10 | Flexible Airfoil-Shaped Flare |
| 12 | Sealed End of Flexible Airfoil-Shaped Flare |
| 13 | Upstream Side of Flexible Airfoil-Shaped Flare |
| 14 | Resealable End of Flexible Airfoil-Shaped Flare |
| 15 | Downstream Side of Flexible Airfoil-Shaped Flare |
| 16 | Particulate Matter |
| 18 | Flare Wall |
| 19 | Flare Tie-Down Loop |
| 20 | Flexible Riffle Sheet |
| 22 | Standard Riffle on Flexible Riffle Sheet |
| 23 | Upstream Edge on Flexible Riffle Sheet |

-continued

| Term | Definition |
|---|---|
| 24 | Large Riffle of Flexible Riffle Sheet |
| 25 | Downstream Edge of Flexible Riffle Sheet |
| 26 | Left Edge of Flexible Riffle Sheet |
| 27 | Right Edge of Flexible Riffle Sheet |
| 28 | Upper Surface of Flexible Riffle Sheet |
| 29 | Lower Surface of Flexible Riffle Sheet |
| 30 | Wall Insert Pocket |
| 32 | Rigid Insert |
| 34 | Top Wall |
| 36 | Sluice Box Tie-Down Loop |
| 38 | Open End of Wall Insert Pocket |
| 39 | Sealed End of Wall Insert Pocket |

DETAILED DESCRIPTION OF THE INVENTION

Figure 7:
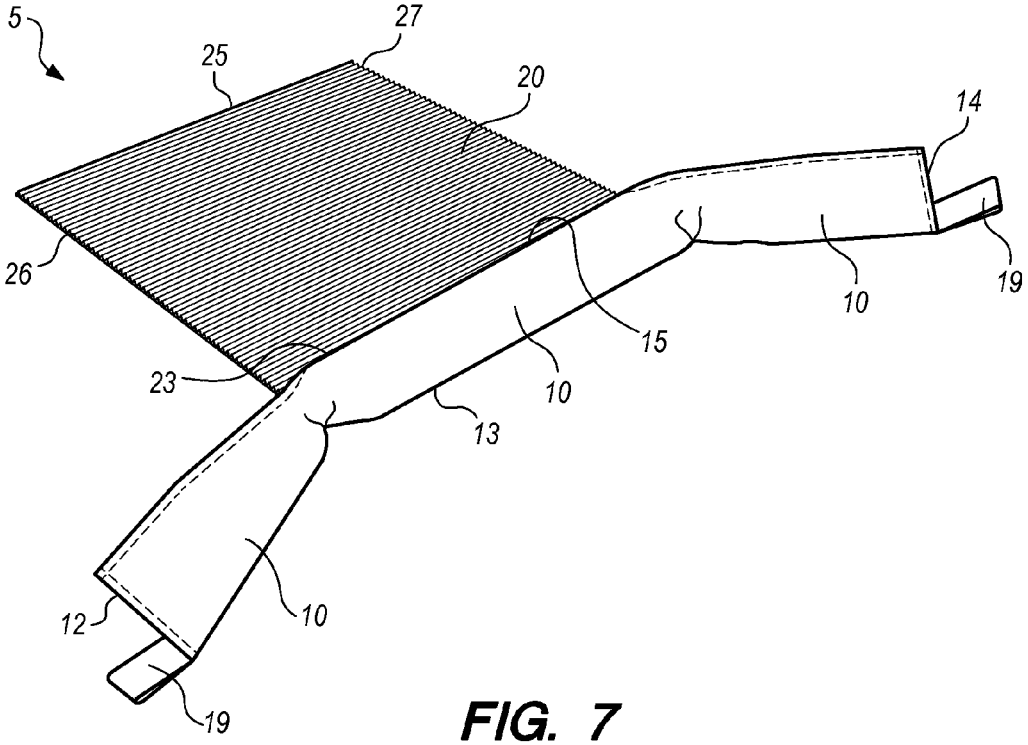
FIG. 7 is a perspective view of the base mode portable flexible sluice box with airfoil-shaped flare.
Figure 8:
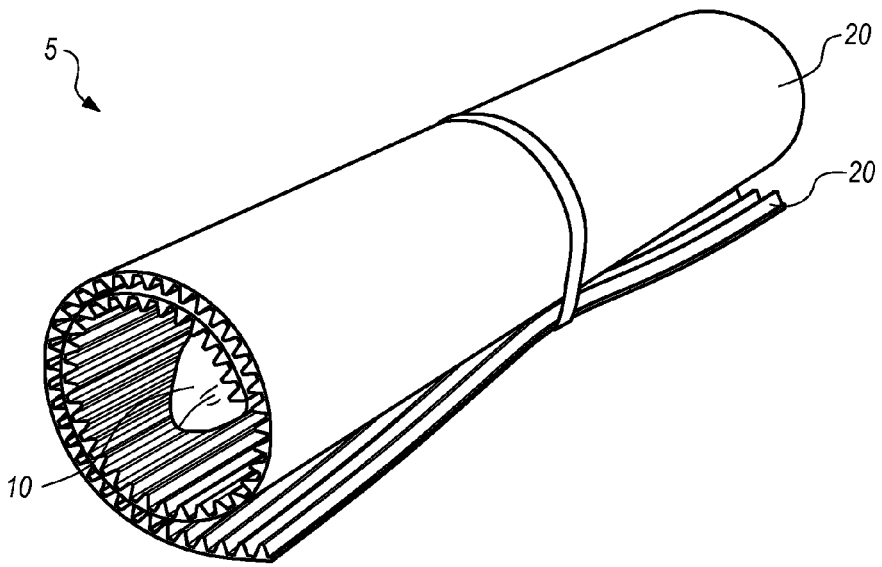
FIG. 8 is a perspective view of base mode portable flexible sluice box with airfoil-shaped flare after the whole device has been rolled up into a compact cylindrical roll for transport.

Portable flexible sluice box with airfoil-shaped flare 5 is flexible. The entire portable flexible sluice box with airfoil-shaped flare 5 can be rolled up into a compact cylindrical roll, as depicted in FIG. 8. Smaller versions of portable flexible sluice box with airfoil-shaped flare 5 can be easily transported by one person. Larger versions of portable flexible sluice box with airfoil-shaped flare 5 can still be rolled up into a compact cylindrical roll, as depicted in FIG. 8, for much easier transport than that of non-flexible sluice boxes. To use portable flexible sluice box with airfoil-shaped flare 5, the compact cylindrical roll is unrolled and spread out flat, as depicted in FIG. 7, onto a portion of a riverbed, creek bed, streambed, or similar that is on an incline of about 5 to 40 degrees where the flow of water from the river, creek, or stream acts as the carrier flow of fluid for the sluice box. The optimal angle yields the proper flow contact time in the sluice box. Alternately, portable flexible sluice box with airfoil-shaped flare 5 could be spread out flat on a piece of dry ground on the same incline range where an external water source is brought in by the user to act as the carrier flow of fluid for the sluice box to operate. Portable flexible sluice box with airfoil-shaped flare 5 is placed in the water flow so that water first flows into the flexible airfoil-shaped flare 10 which funnels the water flow over the attached flexible riffle sheet 20. Portable flexible sluice box with airfoil-shaped flare 5 must be secured to the riverbed, creek bed, streambed, or ground in order to hold it stationary while the flow of the water passes over the portable flexible sluice box with airfoil-shaped flare 5. To begin the sluicing process or separation process, material from the placer deposit, otherwise known as 'pay dirt', is slowly introduced or dropped into the water flow upstream from flexible airfoil-shaped flare 10, where the water flow then carries and lifts the material up and over flexible airfoil-shaped flare 10 to thrust the material in a downward flow onto flexible riffle sheet 20 that is attached to the downstream side of flexible airfoil-shaped flare 10. This downward direction of the carrier flow of fluid is crucial to the proper operation of portable flexible sluice box with airfoil-shaped flare 5. The shape of the airfoil determines the direction of this flow, thus, the shape of the airfoil is crucial to the proper operation of portable flexible sluice box with airfoil-shaped flare 5. Furthermore, flexible airfoil-shaped flare 10 must be flexible so that portable flexible sluice box with airfoil-shaped flare 5 can be rolled up into compact cylindrical roll for transport. The sluice box of this invention accomplishes these aspects with the following design.

Portable flexible sluice box with airfoil-shaped flare 5 comprises a flexible airfoil-shaped flare 10 attached to a flexible riffle sheet 20. Flexible airfoil-shaped flare 10 comprises a hollow oblong flexible tube member with a sealed end 12, an upstream side 13, a resealable end 14, and a downstream side 15. Hollow oblong flexible tube member is a hollow cylindrical tube made of flexible material. Hollow oblong flexible tube member may be a seamless tube of flexible material or may be a seamed tube of flexible material made from a rectangular sheet of flexible material folded along its longitudinal axis with edges permanently attached together to yield a tube with a longitudinal seam. Permanent attachment of edges may be accomplished by any known means to attach or seal layers of flexible fabric or material together capable of containing particulate matter 16 within the hollow oblong flexible tube member while fully immersed in water such as by: sewing, stapling, gluing, welding, clamping, bolting, screwing, epoxy, or similar. Hollow oblong flexible tube member is filled with particulate matter 16 to form an 'airfoil shape'. With the correct amount of particulate matter 16 filling, when laid out flat on the horizontal surface, the hollow oblong flexible tube member resembles a wing of an airplane with a lateral cross section shaped like an airfoil. Oblong flexible tube member may be made of any flexible fabric or material capable of containing particulate matter 16 within the hollow oblong flexible tube member while sealed and fully immersed in water. Flexible fabric or material may be permeable or impermeable. Flexible fabric or material may or may not have apertures. Sealed end 12 is located at one end of the hollow oblong flexible tube member and is sealed to retain particulate matter 16 from spilling out of the inside of the hollow oblong flexible tube member. Sealed end 12 may be accomplished by any known means to attach or seal layers of flexible fabric or material together capable of containing particulate matter 16 within the hollow oblong flexible tube member while fully immersed in water such as by: sewing, stapling, gluing, welding, clamping, bolting, screwing, epoxy, or similar. Resealable end 14 is located at the other end of hollow oblong flexible tube member and may be reversibly unsealed to fill airfoil-shaped flare 10 with particulate matter 16 and reversibly sealed to retain particulate matter 16 from spilling out once filled. Resealable end 14 may be accomplished by any known reversible connector or any known means to reversibly seal a seam or opening in flexible fabric or material capable of containing particulate matter 16 within the hollow oblong flexible tube member when sealed and fully immersed in water such with: a zipper, a tongue and groove seal, a set of hook and loop closure pads, clamps, snaps, buttons, bolts, screws, or other. Best mode means is a hook and loop closure system with one or more hook pads attached to one side of resealable end 14 and one or more loop pads attached to the other side of resealable end 14. The downstream side 15 of hollow oblong flexible tube member is permanently attached to the upstream edge 23 of flexible riffle sheet 20 as described below.

Flexible airfoil-shaped flare 10 is partially filled particulate matter 16. The resealable end 14 is used to provide access through which to fill and/or empty flexible airfoil-shaped flare 10 with particulate matter 16. Particulate matter 16 can be any solid material with a specific gravity larger than that of water and in particulate form with an overall diameter of particle size that is about two inches or less. Particulate matter 16 may be sand, gravel, rocks, stones, buckshot, BB's, pellets, coins, or other material. Flexible airfoil-shaped flare 10 is filled with particulate matter 16 to a level that is about 50-80 percent of its total interior volume.

Figure 1:
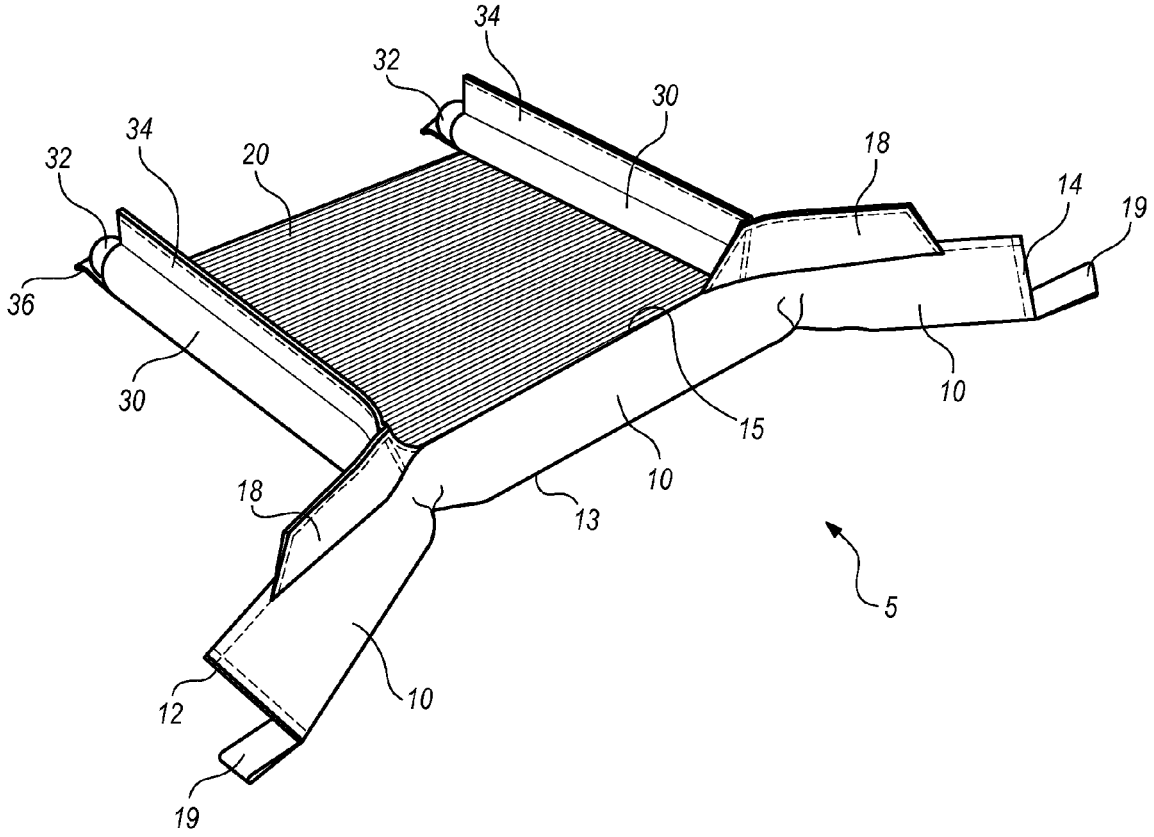
FIG. 1 is a perspective view of portable flexible sluice box with airfoil-shaped flare with optional sluice box wall structure and optional flare walls.
Figure 2:
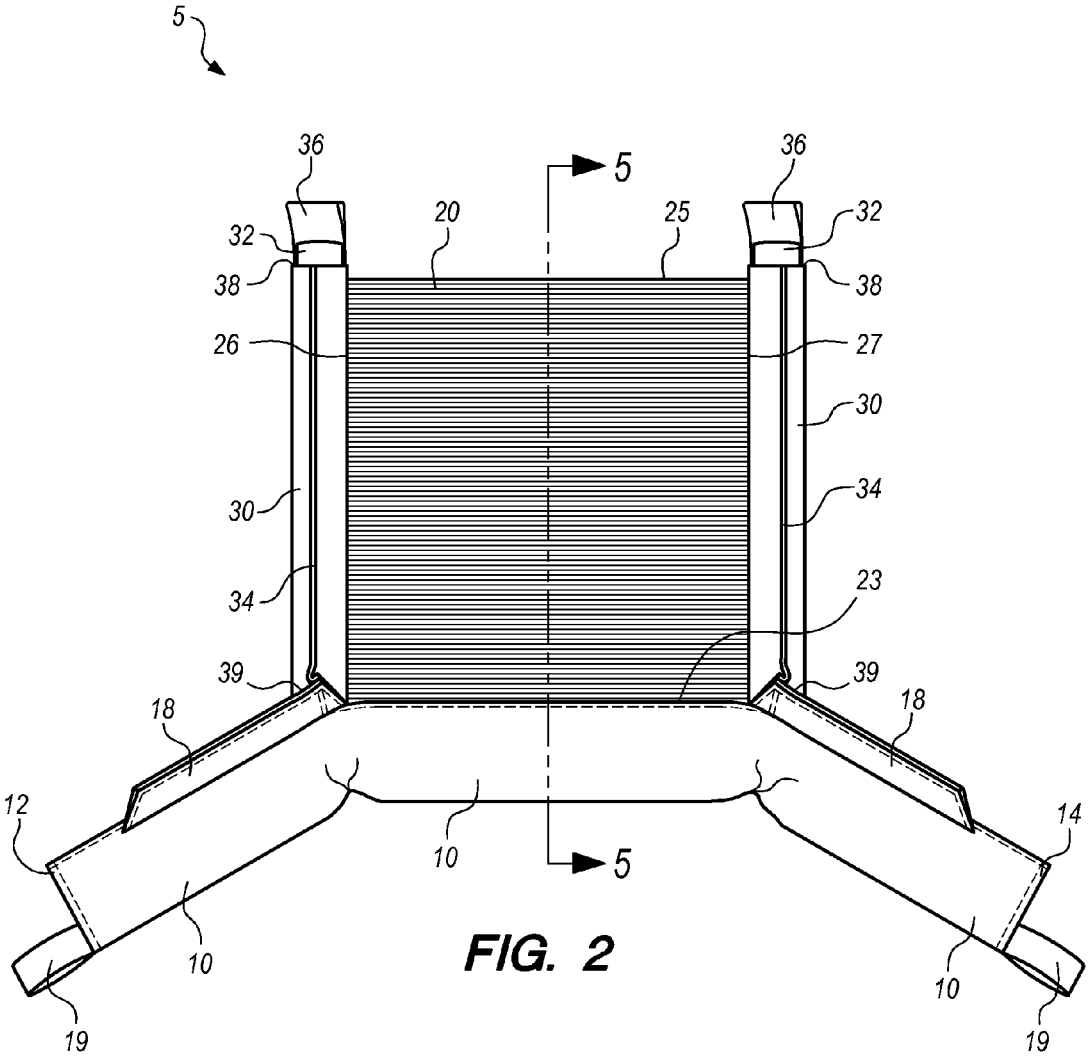
FIG. 2 is a top plan view of portable flexible sluice box with airfoil-shaped flare with optional sluice box wall structure and optional flare walls and also defines cross-sectional plane 5-5.
Figure 3:
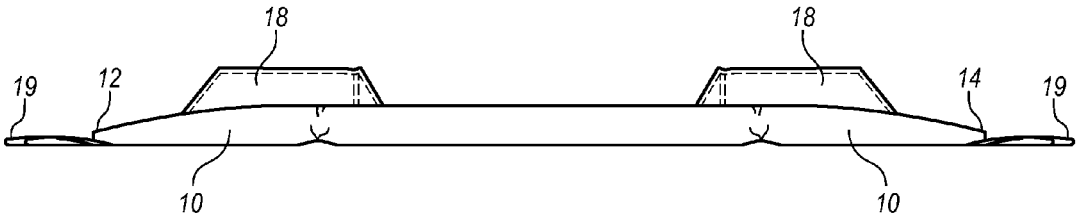
FIG. 3 is a front elevation view of portable flexible sluice box with airfoil-shaped flare with optional sluice box wall structure and optional flare walls.
Figure 4:
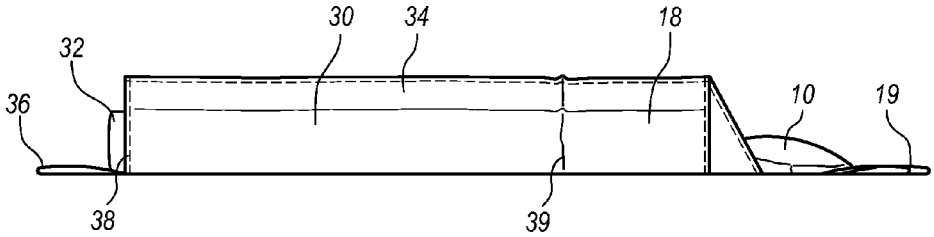
FIG. 4 is a side elevation view of portable flexible sluice box with airfoil-shaped flare with optional sluice box wall structure and optional flare walls.
Figure 5:
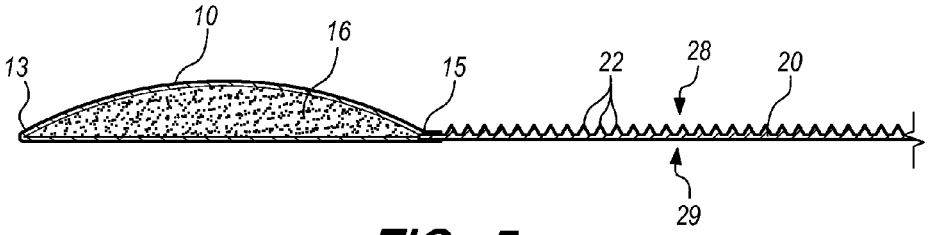
FIG. 5 is a cross sectional view taken from lines 5-5 in FIG. 2.
Figure 10:
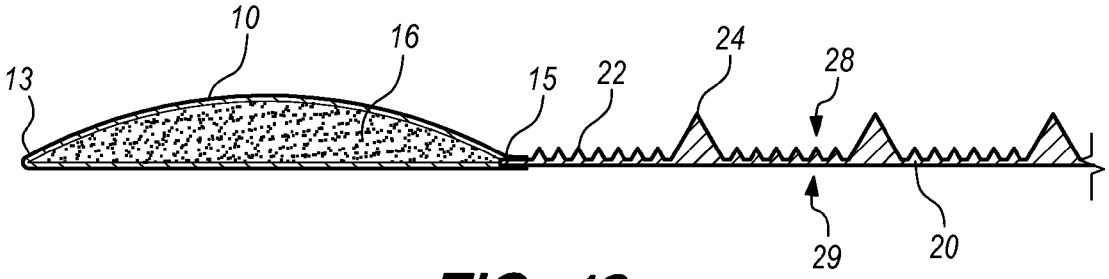
FIG. 10 is cross sectional view taken from lines 10-10 in FIG. 9.

The ideal fill amount is just enough to allow for the upper surface of the flexible tube to be rounded or beveled in a concave upwards shape when the flexible airfoil-shaped flare 10 is laid out flat on a horizontal surface and lightly pressed downwards. This rounded or beveled top creates an airfoil or airfoil-shaped fin that greatly enhances precious metal separation and recovery as described below. The fill amount should be enough to yield a beveled top surface of flexible airfoil-shaped flare 10 but still allow the bottom surface of flexible airfoil-shaped flare 10 to conform to the horizontal surface of the ground upon which it is positioned and to lay flat against the horizontal surface without leaving any gaps between the bottom of flexible airfoil-shaped flare 10 and the horizontal surface. The correct amount of particulate matter 16 filling allows the flexible airfoil-shaped flare 10 to form lateral cross section that is similar to a half moon shape when laid out flat on a horizontal surface as depicted in FIGS. 5 and 10. With too much particulate matter 16 filling, this lateral cross section would resemble more of a three quarter moon or full moon shape. With too little particulate matter 16 filling, this lateral cross section would resemble more of a crescent moon or just plain rectangular flat layer. The correct amount of particulate matter fill 16 must be used to yield the airfoil or airfoil-shaped of the flexible airfoil-shaped flare 10. Particulate matter 16 may be removed to allow for a more compact rolling when portable flexible sluice box with airfoil-shaped flare 5 is rolled up and being transported. Alternately, as discussed below, particulate matter 16 may be left in place when portable flexible sluice box with airfoil-shaped flare 5 is rolled up and being transported.

Flexible airfoil-shaped flare 10 may further comprise at least two flare tie-down loops 19. At least two flare tie-down loops 19 function to secure portable flexible sluice box with airfoil-shaped flare 5 to the riverbed, creek bed, streambed, or ground and to hold it stationary during sluicing operation with water continuously flowing over flexible airfoil-shaped flare 10. Each flare tie-down loop 19 is a loop of strong material that is permanently and strongly attached to airfoil-shaped flare 10. Each flare tie-down loop 19 is secured to the riverbed, creek bed, streambed, ground or similar with a stake, spike, stud, spud, screw, bolt or similar (not depicted).

Flexible riffle sheet 20 is a rectangular-shaped flexible sheet of material with an upstream edge 23, a downstream edge 25, a left edge 26, a right edge 27, an upper surface 28, and a lower surface 29. The upstream edge 23 and the downstream edge 25 are the two short sides of the rectangular-shaped flexible sheet as depicted. The left edge 26 and the right edge 27 are the two long sides of the rectangular-shaped flexible sheet as depicted. The upstream edge 23 of flexible riffle sheet 20 is permanently attached to the downstream side 15 of flexible airfoil-shaped flare 10 as depicted with the longitudinal axis of riffle sheet 20 perpendicular to that of flexible airfoil-shaped flare 10 and intersecting at the midpoint of flexible airfoil-shaped flare 10. Permanent attachment may be accomplished by any known means to attach or seal flexible fabric or material layers together such as by: sewing, stapling, gluing, welding, clamping, bolting, screwing, epoxy, or similar. The lower surface 29 of flexible riffle sheet 20 is relatively flat and smooth. The lower surface 29 flexible riffle sheet 20 functions to make a water tight seal with the riverbed, creek bed, streambed, or ground in order to force the flow of all water and placer deposit material up and over the portable flexible sluice box with airfoil-shaped flare 5 and not underneath it. The upper surface 28 of flexible riffle sheet 20 has a plurality of standard riffles 22, which is a plurality of parallel ridges protruding from the upper surface 28. Each parallel ridge is a straight ridgeline running across the full width of the flexible riffle sheet 20 from its left edge 26 to its right edge 27 and runs perpendicular to the left edge 26 and right edge 27 of flexible riffle sheet 20 and parallel to the other parallel ridges. Each ridgeline may be rounded or pointed at its peak. In between each ridgeline is a valley line running parallel to the adjacent ridgelines. The valley lines between each ridgeline function as obstructions or collection compartments into which heavy metals and/or minerals tend to collect. Each ridgeline and its adjacent valley line is a standard riffle 22. The distance between ridgelines is about 0.05 to 0.4 inches. The distance between a ridgeline and its adjacent valley line or height of each ridge is about 0.5 to 0.4 inches.

Figure 6:
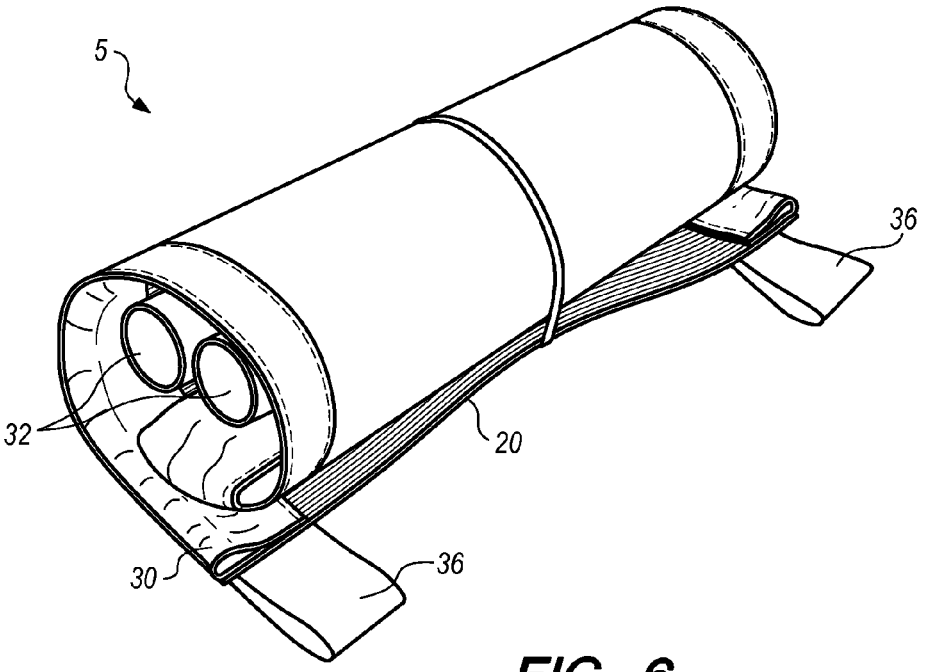
FIG. 6 is a perspective view of portable flexible sluice box with airfoil-shaped flare with optional sluice box wall structure and optional flare walls after the whole device has been rolled up into a compact cylindrical roll for transport.

The above describes the base mode of portable flexible sluice box with airfoil-shaped flare 5, which is depicted in FIGS. 7 and 8. Alternately, portable flexible sluice box with airfoil-shaped flare 5 may further comprise: a set of two wall insert pockets 30 and a set of two rigid inserts 32. FIGS. 1-6 depict portable flexible sluice box with airfoil-shaped flare 5 with the set of two wall insert pockets 30 and the set of two rigid inserts 32. This optional structure essentially adds a wall to the left and right edges of flexible riffle sheet 20 in order to help channel the flow of water over the entire flexible riffle sheet 20 from upstream edge 23 to downstream edge 25. The wall structure is collapsible so that the portable flexible sluice box with airfoil-shaped flare 5 may still be rolled up into a compact cylindrical roll for transport even with the wall structure as depicted in FIG. 6.

Each wall insert pocket 30 is a hollow oblong flexible tube member with a bottom side, a top wall 34, an open end 38, and a sealed end 39. Hollow oblong flexible tube member is a hollow cylindrical tube made of flexible material with a length similar to that of flexible riffle sheet 20. Flexible fabric or material may be permeable or impermeable. Flexible fabric or material may or may not have apertures. Hollow oblong flexible tube member is a 'double seamed' tube of flexible material made from a rectangular sheet of flexible material folded along its longitudinal axis with edges permanently attached together to yield a tube with a longitudinal seam. One end of the hollow oblong flexible tube member is sealed to make sealed end 39. The other end of hollow oblong flexible tube member is left unsealed to make the resealable end 14. The inner width or inner dimension of open end 38 is sized to be slightly larger that the outer diameter of each rigid insert 32 so that there is a slip fit between these members. As discussed below, a rigid insert 32 is inserted into each wall insert pocket 30 to help form rigid wall structure for the sluice box. Permanent attachment of edges may be accomplished by any known means to attach or seal layers flexible fabric or material layers together capable of containing particulate matter 16 within the hollow oblong flexible tube member while fully immersed in water such as by: sewing, stapling, gluing, welding, clamping, bolting, screwing, epoxy, or similar. Two or more rows of attachment or sealing are accomplished to yield an external vertical flap, wing, or tab at the longitudinal seam as depicted. The longitudinal seam is at least double sealed or attached to yield an external vertical flap, wing, or tab at the longitudinal seam as depicted. Each external flap, wing, or tab is a top wall 34. Each top wall 34 is a semi-rigid vertical planar member with enough rigidity to withstand the flow of water against it as water flows over flexible riffle sheet 20 without substantial deflection and to retain the flow of water but with enough flexibility to allow it to be coiled into a roll as depicted in FIG. 6. Planar member may be rectangular, parallelogram-shaped, trapezoidal, square-shaped, or similar. The overall width of the planar member is the height of the wall. The height of each top wall 34 should extend about 0.25 to 60 inches above the hollow oblong flexible tube member. The bottom side of one hollow oblong flexible tube is attached to the left edge 26 of the flexible riffle sheet 20 so that the longitudinal axis of the hollow oblong flexible tube is coincident with the left edge 26 of the flexible riffle sheet 20. The bottom side of the other hollow oblong flexible tube is attached to the right edge 27 of the flexible riffle sheet 20 so that the longitudinal axis of the hollow oblong flexible tube is coincident with the right edge 27 of the flexible riffle sheet 20. Attachment may be accomplished by any known means such as by: sewing, stapling, gluing, welding, clamping, bolting, screwing, epoxy, or similar. The open end 38 of each hollow oblong flexible tube is located at the downstream edge of flexible riffle sheet 20. The sealed end 39 of each hollow oblong flexible tube member is located at the upstream edge 23 of flexible riffle sheet 20. Sealed end 39 of hollow oblong flexible tube member may be accomplished by any known means to seal flexible fabric or material such as by: sewing, stapling, gluing, welding, clamping, bolting, screwing, epoxy, or similar. The sealed end 39 of each hollow oblong flexible tube member is attached to the downstream side 15 flexible airfoil-shaped flare 10 as depicted. Attachment may be accomplished by any known means to seal flexible fabric or material such as by: sewing, stapling, gluing, welding, clamping, bolting, screwing, epoxy, or similar.

Each rigid insert 32 is a rigid oblong member. One rigid insert 32 is inserted into each wall insert pocket 30 to add rigid structure to the flexible material of the wall insert pocket 30 to help form a rigid wall for the sluice box. A rigid wall for a sluice box is desirable to prevent the flow of water and placer material over the left and right edges 26,27 of flexible riffle sheet 20. The water and placer material must flow across the full length of flexible riffle sheet 20 for proper separation. Each rigid insert 32 has a length slightly longer than that of flexible riffle sheet 20 by about 0.5-12 inches. The overall outer width or dimension and exterior shape of each rigid insert 32 must be slightly less than the inner width or dimension of each wall insert pocket 30 so that each rigid insert 32 can form a slip fit inside one wall insert pocket 30. A rigid insert 32 is slid all the way into each wall insert pocket 30 for sluicing operation. For transport, the rigid inserts 32 are removed from the wall insert pockets 30 and placed parallel and adjacent to the flexible airfoil-shaped flare 10. From this position the portable flexible sluice box with airfoil-shaped flare 5 may still be rolled up into a compact cylindrical roll for transport even with the wall structure as depicted in FIG. 6. Best mode rigid insert 32 is a length of PVC pipe.

Flexible airfoil-shaped flare 10 may further comprise at least two sluice box tie-down loops 36. At least two sluice box tie-down loops 36 function to secure the flexible riffle sheet 20 to the riverbed, creek bed, streambed, or ground and to hold it stationary during sluicing operation with water continuously flowing over flexible airfoil-shaped flare 10. Each sluice box tie-down loop 36 is a loop of strong material that is permanently and strongly attached to a wall insert pocket 30. Each sluice box tie-down loop 36 is secured to the riverbed, creek bed, streambed, ground or similar with a stake, spike, stud, spud, screw, bolt or similar (not depicted).

Alternately, portable flexible sluice box with airfoil-shaped flare 5 may further comprise a set of two flare walls 18. FIGS. 1-6 depict portable flexible sluice box with airfoil-shaped flare 5 with the set of two flare walls 18. This optional structure essentially adds two walls to the top of the flexible airfoil-shaped flare 10 to help funnel the flow of water over the flexible riffle sheet 20. It can be seen from the figures that the length of flexible airfoil-shaped flare 10 is considerably longer than the width of flexible riffle sheet 20. Through the use of two flare walls 18, all water and placer material flowing over the full length flexible airfoil-shaped flare 10 is channeled down and funneled over the flexible riffle sheet 20 for more efficient processing. The wall structure is collapsible so that the portable flexible sluice box with airfoil-shaped flare 5 may still be rolled up into a compact cylindrical roll for transport even with the wall structure as depicted in FIG. 6.

Each flare wall 18 is a semi-rigid vertical planar member with a width, a height, a top end and a bottom end. The bottom end of each flare wall 18 is permanently attached to the downstream side 15 of flexible airfoil-shaped flare 10 as depicted. Permanent attachment may be accomplished by any known means to attach or seal flexible fabric or material layers together such as by: sewing, stapling, gluing, welding, clamping, bolting, screwing, epoxy, or similar. Semi-rigid vertical planar member must have enough rigidity to withstand the flow of water against it as water flows over flexible riffle sheet 20 without substantial deflection and to retain the flow of water but with enough flexibility to allow it to be coiled into a roll as depicted in FIG. 6. The height of each flare wall 10 should be about 0.25 to 60 inches. The width of one flare wall 10 should extend from the left edge of flexible riffle sheet 20 to the sealed end 12 of flexible airfoil-shaped flare 10 or alternately just shy of the sealed end 12 by about 0.25-12 inches. The width of the other flare wall 10 should extend from the right edge of flexible riffle sheet 20 to the resealable end 14 of flexible airfoil-shaped flare 10 or alternately just shy of the resealable end 14 by about 0.25-12 inches. Vertical planar member may be rectangular, parallelogram-shaped, trapezoidal, square-shaped, or similar.

Figure 9:
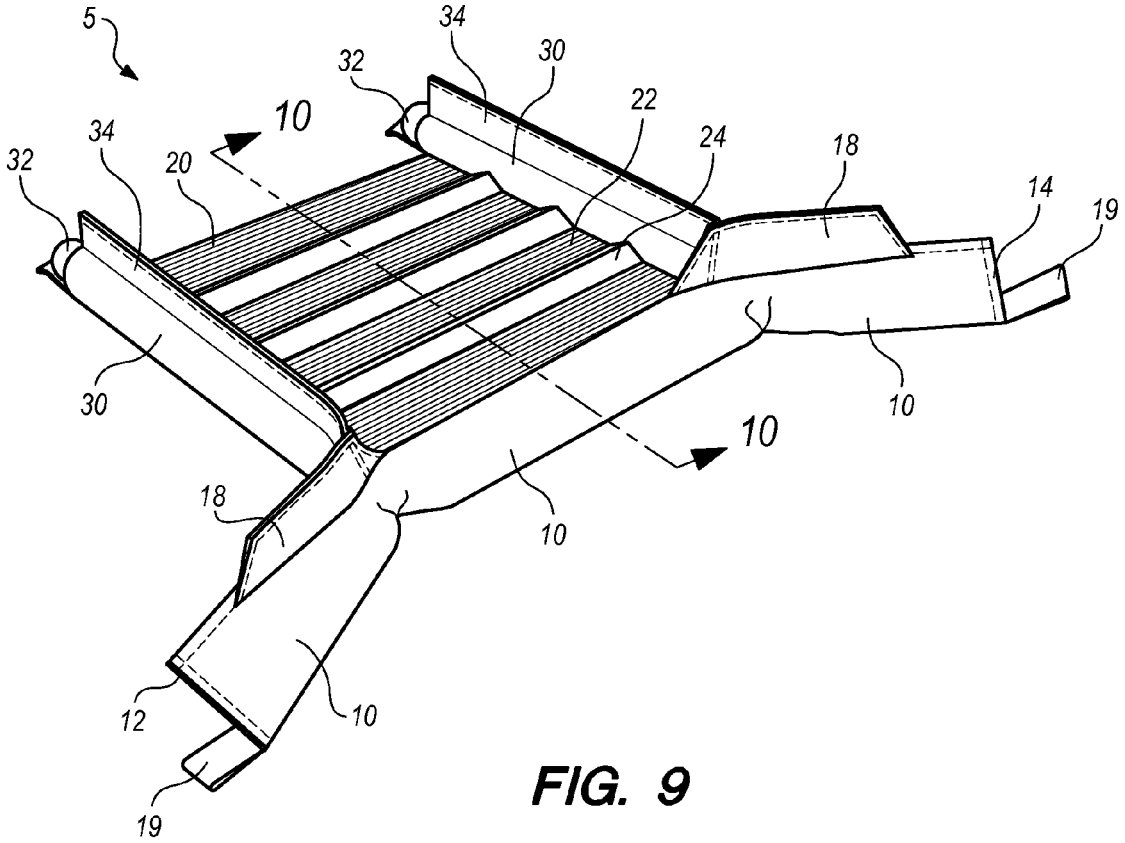
FIG. 9 is a perspective view of portable flexible sluice box with airfoil-shaped flare with optional sluice box wall structure, optional large riffles, and optional flare walls and also defines cross-sectional plane 10-10.

Alternately, the upper surface 28 of flexible riffle sheet 20 may have a plurality of large riffles 24, which is a plurality of larger parallel ridges protruding from the upper surface 28. FIGS. 9-10 depict portable flexible sluice box with airfoil-shaped flare 5 with a plurality of large riffles 24. Each large riffle 24 or larger parallel ridge is a straight ridgeline running across the full width of the flexible riffle sheet 20 from its left edge 26 to its right edge 27 and runs perpendicular to the left edge 26 and right edge 27 of flexible riffle sheet 20 and parallel to the other parallel ridges. Each large riffle 24 may be rounded or pointed at its peak. In between each large riffle 24 is a plurality of standard riffles 22 as depicted. The space between each large riffle 24 functions as collection compartment in and of itself for larger sized pieces of heavy metals and/or minerals that may be too large to settle between standard riffles 22. The distance between ridgelines of large riffles 24 is about 1 to 96 inches. The distance between a ridgeline and its adjacent valley line or height of each ridge of a large riffle 24 is about 0.41 to 24 inches.

What is claimed is:

1. A portable flexible sluice box with airfoil-shaped flare comprising: a flexible airfoil-shaped flare that is partially filled with a particulate matter and attached to a flexible riffle sheet, wherein:

said flexible airfoil-shaped flare comprises a hollow oblong flexible tube member with a sealed end, an upstream side, a resealable end, and a downstream side;

said particulate matter is any solid material with a specific gravity larger than that of water and in particulate form with an overall diameter of particle size that is 0.001 to 2 inches inclusive;

said hollow oblong flexible tube member is partially filled with just enough said particulate matter to form an airfoil-shaped lateral cross section of flexible airfoil-shaped flare when laid out flat on a horizontal surface;

said flexible riffle sheet 20 is a rectangular-shaped flexible sheet of material with an upstream edge, a downstream edge, a left edge, a right edge, an upper surface, and a lower surface, where said upstream edge and said downstream edge are the two short sides of said rectangular-shaped flexible sheet and said left edge and said right edge are the two long sides of said rectangular-shaped flexible sheet;

said upstream edge of said flexible riffle sheet is permanently attached to said downstream side of said flexible airfoil-shaped flare 10 with the longitudinal axis of said riffle sheet 20 perpendicular to that of said flexible airfoil-shaped flare and intersecting at the midpoint of said flexible airfoil-shaped flare; and said upper surface of said flexible riffle sheet has a plurality of standard riffles where each of said plurality of standard riffles is a parallel ridge protruding 0.05 to 0.40 inches from said upper surface and each said parallel ridge is a straight ridgeline running across the full width of said rectangular-shaped flexible sheet of material from said left edge to said right edge and runs perpendicular to said left edge and said right edge of said flexible riffle sheet and parallel to all other said parallel ridges.

2. A portable flexible sluice box with airfoil-shaped flare as recited in claim 1, wherein said upper surface of said riffle sheet further comprises a plurality of large riffles, wherein:

each of said plurality of large riffles is a parallel ridge protruding 0.41 to 24 inches upwards from said upper surface of said flexible rifle riffle sheet and is a straight ridgeline running across the full width of said rectangular-shaped flexible sheet of material from said left edge to said right edge running perpendicular to said left edge and said right edge of said flexible riffle sheet and parallel to all other said plurality of large ridges;

there exists a plurality of said standard rifles riffles between each of said plurality of large riffles; and each of said plurality of large riffles is parallel to each of said plurality of standard rifles riffles.

3. A portable flexible sluice box with airfoil-shaped flare as recited in claim 1 further comprising: a first wall insert pocket; a second wall insert pocket, a first rigid insert, and a second rigid insert, wherein:

said first and second wall insert pockets are each a hollow oblong flexible tube member with a bottom side, a top wall, an open end, and a sealed end;

said bottom side of said first wall insert pocket is permanently attached to said left edge of said flexible riffle sheet so that the longitudinal axis of said first wall insert pocket is coincident with said left edge of said flexible riffle sheet;

said bottom side of said second wall insert pocket is permanently attached to said right edge of said flexible riffle sheet so that the longitudinal axis of said second wall insert pocket is coincident with said right edge of said flexible riffle sheet;

said first insert is a rigid oblong member with a length and a width that is sized to make slip fit inside said hollow oblong flexible tube member of said first wall insert pocket;

said second insert is a rigid oblong member with a length and a width that is sized to make slip fit inside said hollow oblong flexible tube member of said second wall insert pocket;

said first rigid insert is inserted into said first wall insert pocket; and said second rigid insert is inserted into said second wall insert pocket.

4. A portable flexible sluice box with airfoil-shaped flare as recited in claim 3, wherein said upper surface of said riffle sheet further comprises a plurality of large riffles, wherein:

each of said plurality of large riffles is a parallel ridge protruding 0.41 to 24 inches upwards from said upper surface of said flexible rifle riffle sheet and is a straight ridgeline running across the full width of said rectangular-shaped flexible sheet of material from said left edge to said right edge running perpendicular to said left edge and said right edge of said flexible riffle sheet and parallel to all other said plurality of large ridges;

there exists a plurality of said standard riffles between each of said plurality of large riffles; and each of said plurality of large riffles is parallel to each of said plurality of standard riffles.

5. A portable flexible sluice box with airfoil-shaped flare as recited in claim 3 further comprising a first flare wall and second flare wall, wherein:

said first and second flare walls are each a semi-rigid vertical planar member with a width, a height, a top end and a bottom end;

said bottom end of said first flare wall is permanently attached to said downstream edge of said flexible airfoil-shaped flare; and said bottom end of said second flare wall is permanently attached to said downstream edge of said flexible airfoil-shaped flare.

6. A portable flexible sluice box with airfoil-shaped flare as recited in claim 5, wherein said upper surface of said riffle sheet further comprises a plurality of large riffles, wherein:

each of said plurality of large riffles is a parallel ridge protruding 0.41 to 24 inches upwards from said upper surface of said flexible riffle sheet and is a straight ridgeline running across the full width of said rectangular-shaped flexible sheet of material from said left edge to said right edge running perpendicular to said left edge and said right edge of said flexible riffle sheet and parallel to all other said plurality of large ridges;

there exists a plurality of said standard riffles between each of said plurality of large riffles; and each of said plurality of large riffles is parallel to each of said plurality of standard riffles.

* * * * *